US010718121B2

(12) United States Patent
Schneider

(10) Patent No.: US 10,718,121 B2
(45) Date of Patent: Jul. 21, 2020

(54) CEILING TABLE AND CEILING FORMWORK COMPRISING SUCH A CEILING TABLE

(71) Applicant: Peri GmbH, Weissenhorn (DE)

(72) Inventor: Werner Schneider, Erbach (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 16/087,549

(22) PCT Filed: Mar. 6, 2017

(86) PCT No.: PCT/EP2017/055209
§ 371 (c)(1),
(2) Date: Sep. 21, 2018

(87) PCT Pub. No.: WO2017/162423
PCT Pub. Date: Sep. 28, 2017

(65) Prior Publication Data

US 2019/0085571 A1 Mar. 21, 2019

(51) Int. Cl.

| | |
|---|---|
| ***E04G 11/38*** | (2006.01) |
| ***E04G 11/50*** | (2006.01) |
| ***E04G 11/48*** | (2006.01) |
| ***E04G 9/04*** | (2006.01) |
| *E04G 9/02* | (2006.01) |

(52) U.S. Cl.
CPC ..... *E04G 11/38* (2013.01); *E04G 9/04* (2013.01); *E04G 11/48* (2013.01); *E04G 11/50* (2013.01); *E04G 2009/023* (2013.01); *E04G 2009/028* (2013.01)

(58) Field of Classification Search
CPC ..... E04G 11/36; E04G 11/38; E04G 11/48; E04G 11/483; E04G 11/486; E04G 11/50; E04G 2011/505
USPC ..... 249/18, 26, 28
See application file for complete search history.

(56) References Cited

U.S. PATENT DOCUMENTS

| | | | | |
|---|---|---|---|---|
| 3,364,647 | A | 1/1968 | Hubmann | |
| 2010/0025563 | A1* | 2/2010 | Seng | E04G 11/02 249/24 |

FOREIGN PATENT DOCUMENTS

| | | |
|---|---|---|
| AU | 2014289215 | 2/2016 |
| DE | 102012211388 A1 | 1/2014 |
| EP | 1715118 | 10/2006 |

(Continued)

*Primary Examiner* — Michael Safavi
(74) *Attorney, Agent, or Firm* — Loginov & Associates, PLLC; William A. Loginov

(57) ABSTRACT

A ceiling table for a partial formwork of a concrete ceiling. The ceiling table has at least one formwork element, in particular multiple formwork elements, which can be assembled on a lower frame of the ceiling table in a nondestructive manner and which can be disassembled from the lower frame. The ceiling table has a support skeleton on which at least one formwork element, in particular multiple formwork elements, is/are arranged. The support skeleton can have multiple braces which can be connected together and separated from one another in a nondestructive manner. The support skeleton preferably has a pair of main supports, in particular parallel running main supports, on which a pair of edge supports and at least one central support that is arranged between the edge supports are arranged. The edge supports and the central support run preferably parallel to one another.

12 Claims, 6 Drawing Sheets

(56) References Cited

FOREIGN PATENT DOCUMENTS

| | | | | |
|---|---|---|---|---|
| ES | 2310956 | | 1/2009 | |
| WO | 2012058696 | | 5/2012 | |
| WO | WO-2015/004188 | * | 1/2015 | ..... E04G 11/38 |

* cited by examiner

CEILING TABLE AND CEILING FORMWORK COMPRISING SUCH A CEILING TABLE

FIELD OF THE INVENTION

The invention relates to a ceiling table for a ceiling formwork, the ceiling table having a lower frame comprising multiple supports. The invention further relates to a ceiling formwork comprising such a ceiling table.

BACKGROUND OF THE INVENTION

The use of formwork elements to build concrete ceilings is known. In particular, frame panel formwork elements are used that at least partially form a mold to be filled with liquid concrete. Once the concrete has hardened, the formwork elements are removed.

Using the formwork elements, ceilings can be designed flexibly because the ceiling formwork is assembled from many individual formwork elements. To pour concrete quickly for large-area ceilings, it has been proven useful to use ceiling tables that have a lower frame and a large formwork surface. Such ceiling tables are brought to the next floor using a transportation fork once the freshly poured concrete ceiling has hardened. The disadvantage of the known ceiling tables is that they are cumbersome to transport and can only be used in an inflexible manner. Furthermore, the known ceiling tables are often incompatible with other formwork elements.

SUMMARY OF THE INVENTION

The object of the present invention is therefore to create a ceiling table that makes it possible to quickly create a ceiling framework with maximum flexibility. The object of the invention is also to provide a ceiling formwork comprising such a ceiling table.

This object is achieved according to the invention by a ceiling table of a ceiling formwork, the ceiling table having a lower frame comprising multiple supports, characterized in that the ceiling table has a support skeleton that is attached to the lower frame, the ceiling table having multiple formwork elements, the formwork elements each having a formwork element frame and a formwork shell arranged on the formwork element frame, at least one formwork element being attached to the support skeleton in a reversibly detachable manner and by a ceiling framework comprising a ceiling table, a support head and a further formwork element, the support head being arranged on the further formwork element in a reversibly detachable manner and arranged on the ceiling table in a reversibly detachable manner. The dependent claims specify useful further developments.

The object according to the invention is thus achieved by a ceiling table comprising a lower frame having multiple supports. The ceiling table has a support skeleton. The support skeleton is arranged or formed on the lower frame. Formwork elements are mounted to the support skeleton. The formwork elements have a formwork element frame. A formwork shell of the formwork element is arranged on the formwork element frame. At least one formwork element is mounted to the support skeleton in a reversibly detachable manner.

The ceiling table can be flexibly adapted to a building structure via the at least one formwork element that is mounted in a reversibly detachable manner. For example, the at least one formwork element that is mounted in a reversibly detachable manner can be removed from the ceiling table to create a cavity for a concrete column. Because of the at least partial disassembly capability of the ceiling table, the ceiling table can furthermore be transported in a compact manner with a truck.

According to the invention, a ceiling table of a ceiling formwork is in particular a (preferably rigid) unit for creating a ceiling formwork that makes uniform implementation together with the supports of the ceiling table and the formwork elements of the ceiling table possible.

The flexibility of the ceiling table is further increased if multiple formwork elements, in particular all formwork elements, of the ceiling table are mounted to the support skeleton in a reversibly detachable manner.

Alternatively or in addition to this, the lower frame can be arranged on the support skeleton in a reversibly detachable manner.

The support skeleton can have a first main support and a first edge support that is mounted to the first main support in a reversibly detachable manner. The support skeleton can be designed particularly flexibly as a result.

The at least one formwork element is preferably rectangular. Furthermore, multiple formwork elements, in particular all formwork elements, are preferably rectangular.

The formwork elements can be identical in design to make the construction of the ceiling table easier.

To easily arrange the at least one formwork element that is mounted to the support skeleton in a reversibly detachable manner and to be able to remove it from the support skeleton, the longitudinal axis of the first main support preferably runs perpendicularly offset relative to the longitudinal axis of the first edge support.

The support skeleton can have a second edge support that is mounted to the first main support in a reversibly detachable manner. The longitudinal axis of the second edge support preferably runs parallel to the longitudinal axis of the first edge support.

In a further preferred embodiment of the invention, the support skeleton has a second main support. The longitudinal axis of the second main support can run parallel to the first main support. The second main support can be mounted to the first edge support in a reversibly detachable manner. Alternatively or in addition to this, the second main support can be arranged on the second edge support in a reversibly detachable manner.

To arrange multiple formwork elements on the support skeleton, the support skeleton can have at least one central support that is arranged on the first main support in a reversibly detachable manner. The longitudinal axis of the central support can run parallel to the longitudinal axis of the first edge support and/or parallel to the longitudinal axis of the second edge support.

In a further embodiment of the ceiling table, the lower frame can have multiple rolls such that the ceiling table can easily be displaced.

At least one formwork element, preferably multiple formwork elements, in particular all formwork elements, can each have a coupling point, in particular in the form of at least one locking projection, to arrange a support head of the ceiling formwork. As a result of this, the formwork surface of the ceiling table can be expanded in a particularly flexible manner with further formwork elements.

Alternatively or in addition to this, at least one formwork element can have at least one plastic corner. As a result of this, damaged corners that are especially at risk on formwork elements can be repaired easily by replacing the plastic corner.

The object according to the invention is further achieved by a ceiling formwork comprising a previously described ceiling table, a support head and a further formwork element. The support head can be arranged to the further formwork element in a reversibly detachable manner as well as arranged on the ceiling table in a reversibly detachable manner. The ceiling formwork thus comprises a ceiling table that was expanded by a further formwork element.

The ceiling formwork can have a ceiling support comprising the support head and a formwork support such that the further formwork element can be supported on the substrate not only via the ceiling table, but also via the ceiling support.

Further features and advantages of the invention are presented in the following description of multiple exemplary embodiments of the invention, in the claims and in the figures of the drawing that shows details that are essential to the invention.

The features shown in the drawing are depicted in such a way that the special features according to the invention can be made clearly visible. The various features can each be realized in variants of the invention individually or in groups in any combination.

BRIEF DESCRIPTION OF THE DRAWINGS

Shown are.

DETAILED DESCRIPTION

Figure 1:
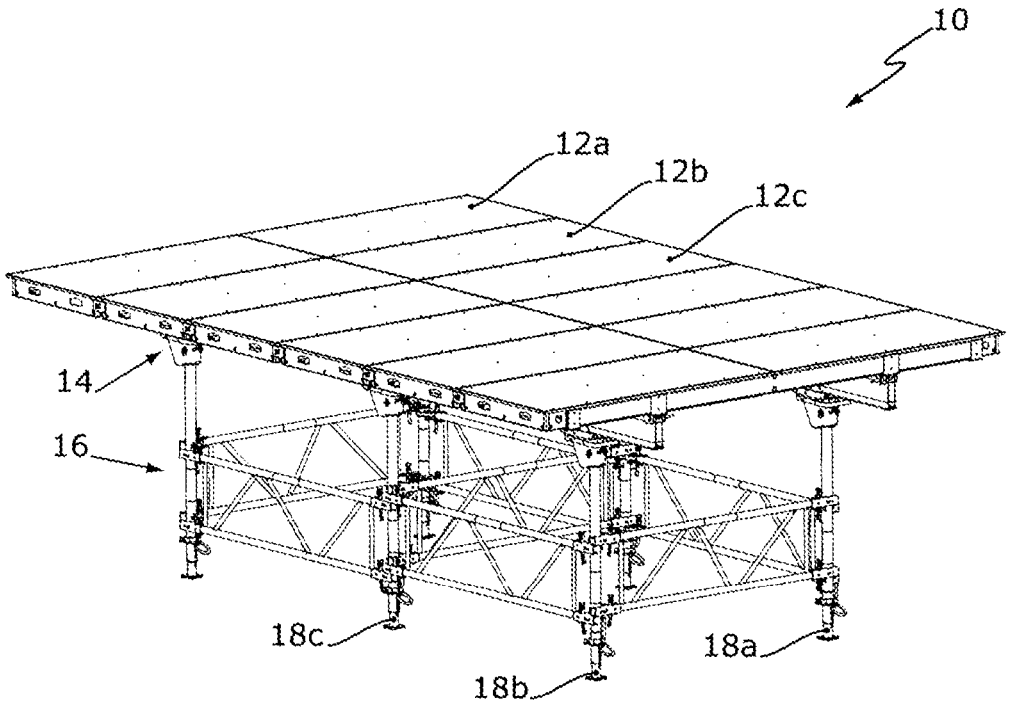
FIG. 1 is a perspective view of a ceiling table comprising multiple formwork elements and a lower frame.

FIG. 1 shows a ceiling table 10 comprising multiple formwork elements of which only formwork elements 12*a-c* are provided with a reference character for the sake of clarity. Formwork elements 12*a-c* are arranged on a support skeleton 14 of ceiling table 10 in such a way that they can be removed without being destroyed. Support skeleton 14 is arranged on a lower frame 16 comprising multiple supports of which only supports 18*a-c* are provided with a reference character for the sake of clarity. Support skeleton 14 is arranged on lower frame 16 in a reversibly detachable manner. Individual parts of support skeleton 14 are explained below.

Figure 2:
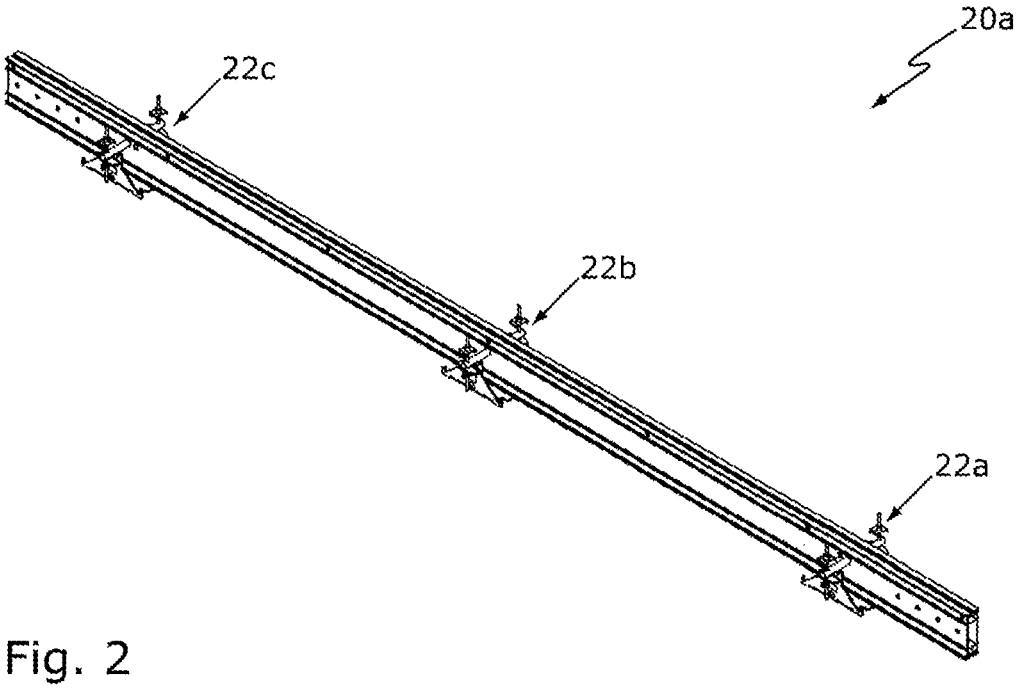
FIG. 2 is a perspective view of a main support of the ceiling table according to FIG. 1.

FIG. 2 shows a first main support 20*a* of support skeleton 14 (see FIG. 1) comprising attachment points 22*a-c* for lower frame 16 (see FIG. 1).

Figure 3:
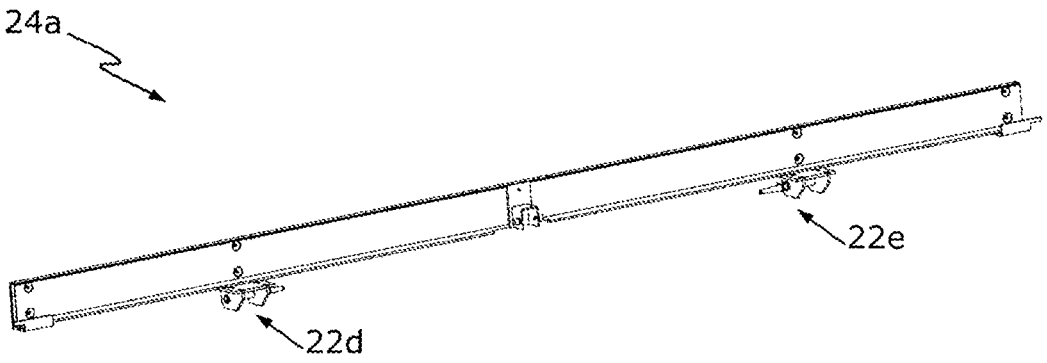
FIG. 3 is a perspective view of an edge support of the ceiling table according to FIG. 1.

FIG. 3 shows a first edge support 24*a* of support skeleton 14 (see FIG. 1). First edge support 24*a* has attachment points 22*d*, 22*e* for mounting first edge support 24*a* to first main support 20*a* in a reversibly detachable manner (see FIGS. 2 and 4).

Figure 4:
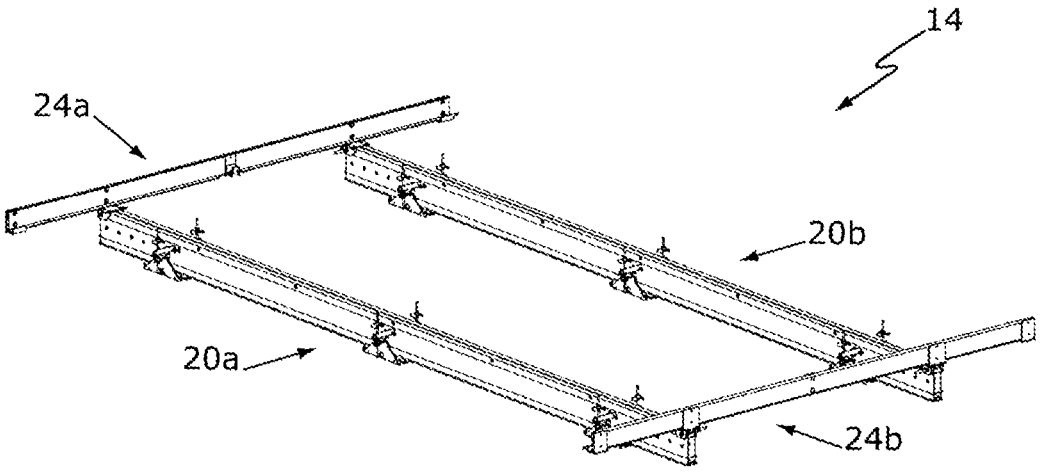
FIG. 4 is a perspective view of a support skeleton of a ceiling table comprising two main supports and two edge supports.

FIG. 4 shows a support skeleton 14 comprising a first edge support 24*a* and a second edge support 24*b*. Edge supports 24*a*, 24*b* are arranged on first main support 20*a* and a second main support 20*b* in a reversibly detachable manner.

Figure 5:
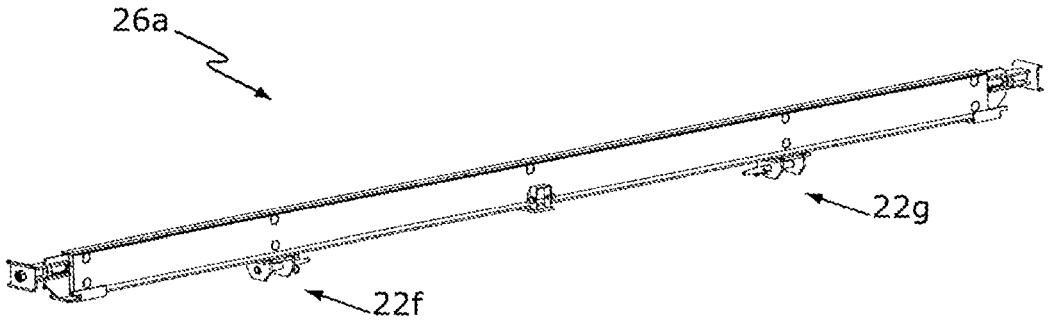
FIG. 5 is a perspective view of a central support.

FIG. 5 shows a first central support 26*a* of support skeleton 14 (see FIG. 1). First central support 26*a* has attachment points 22*f*, 22*g*. Attachment points 22*f*, 22*g* of first central support 26*a* are designed identical to attachment points 22*d*, 22*e* (see FIG. 3) of first edge support 24*a*. First central support 26*a* can, as a result, be arranged on main supports 20*a*, 20*b* (see FIG. 4) in a simple manner—just like first edge support 24*a*.

Figure 6:
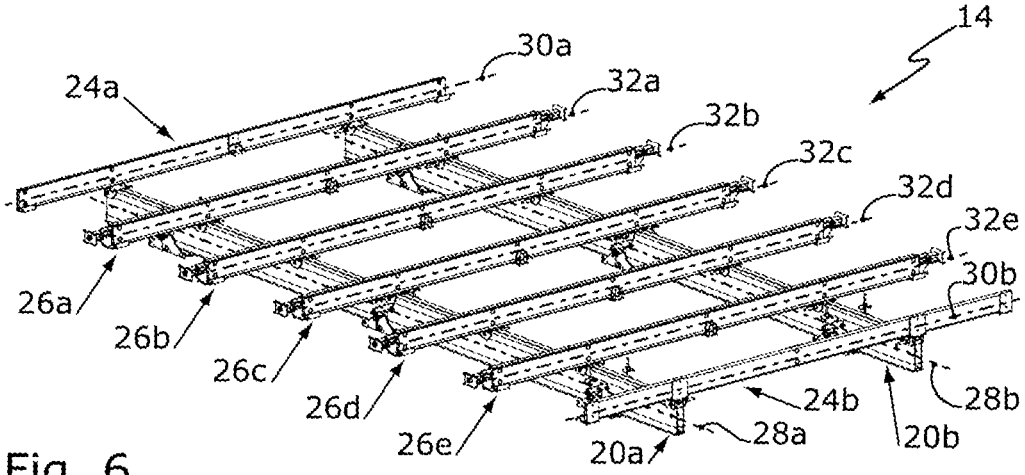
FIG. 6 is a perspective view of a support skeleton comprising multiple central supports.

FIG. 6 shows a support skeleton 14 comprising multiple main supports 20*a*, 20*b* as well as edge supports 24*a*, 24*b* and central supports 26*a-e* arranged on main supports 20*a*, 20*b* in a reversibly detachable manner. Longitudinal axes 28*a*, 28*b* of main supports 20*a*, 20*b* run parallel to each other. Longitudinal axes 30*a*, 30*b* of edge supports 24*a*, 24*b* run offset and perpendicular to longitudinal axes 28*a*, 28*b* of main supports 20*a*, 20*b*. Furthermore, longitudinal axes 32*a-e* of central supports 26*a-e* run offset and parallel to longitudinal axes 28*a*, 28*b* of main supports 20*a*, 20*b*. As a result, support skeleton 14 forms receiving frame that can be expanded and reduced in size flexibly for multiple rectangular formwork elements 12*a-c* (see FIGS. 7 and 8).

Figure 7:
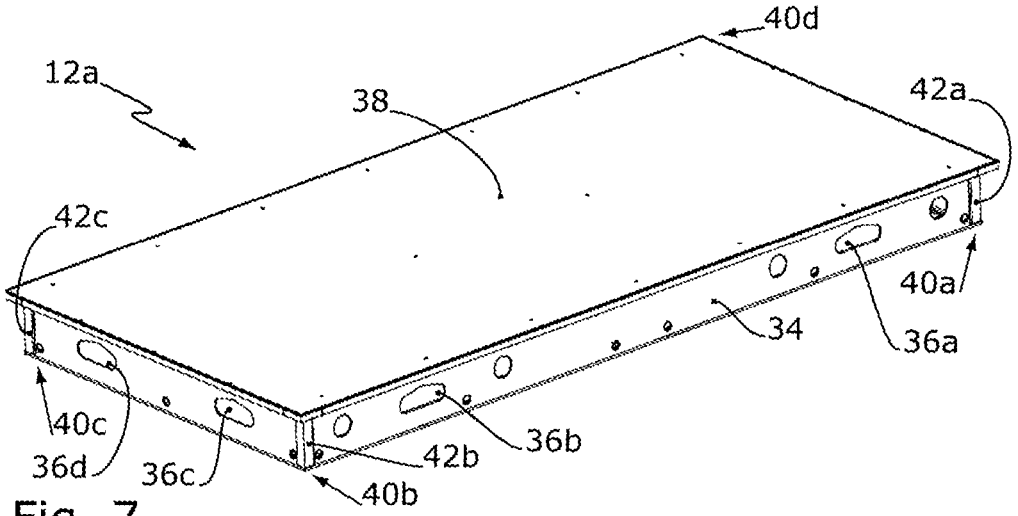
FIG. 7 is a perspective view of a formwork element.

FIG. 7 shows first formwork element 12*a* (see also FIG. 1). First formwork element 12*a* has a formwork element frame 34. Formwork element frame 34 preferably has at least one carrying aperture 36*a-d*. A formwork shell 38 is arranged on formwork element frame 34. Formwork element frame 34 is made from metal, in particular from steel or aluminum. To manufacture formwork element frame 34 in a simplified manner and easily repair damage to a corner of first formwork element 12*a*, first formwork element 12*a* has plastic cladding 42*a-c* on its corners 40*a-d*, only plastic cladding 42*a-c* of corners 40-*ac* being visible in FIG. 7 due to the perspective representation of first formwork element 12*a*.

Figure 8:
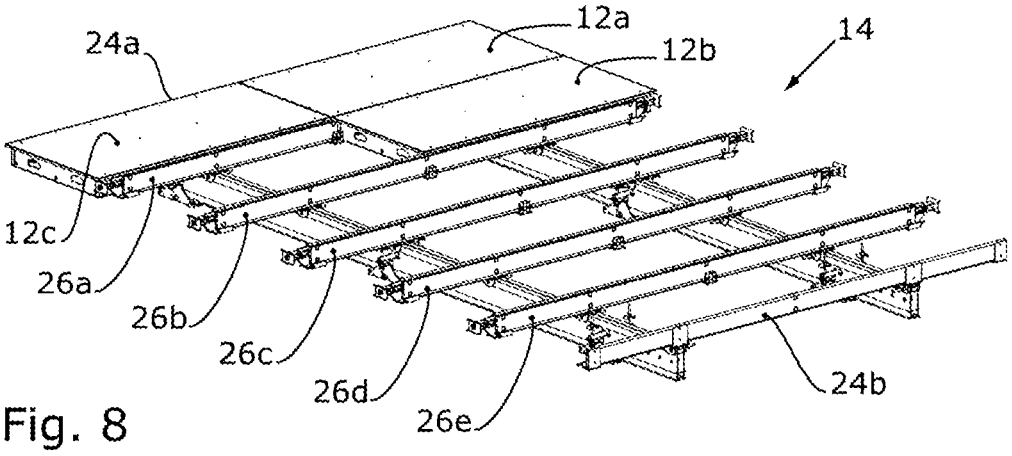
FIG. 8 is a perspective view of the support skeleton from FIG. 6 comprising multiple formwork elements according to FIG. 7.

FIG. 8 shows support skeleton 14 according to FIG. 6 with formwork elements 12*a-c* arranged thereon (see also FIG. 7). Formwork elements 12*a-c* are identical in design. In each case, two formwork elements 12*a-c* can be arranged between two central supports 26*a-e* or between an edge support 24*a*, 24*b* and the central support 26*a*, 26*e* nearest to edge support 24*a*, 24*b*. Formwork elements 12*a-c* can be mounted to support skeleton 14 and removed from support skeleton 14 independently of one another.

Figure 9:
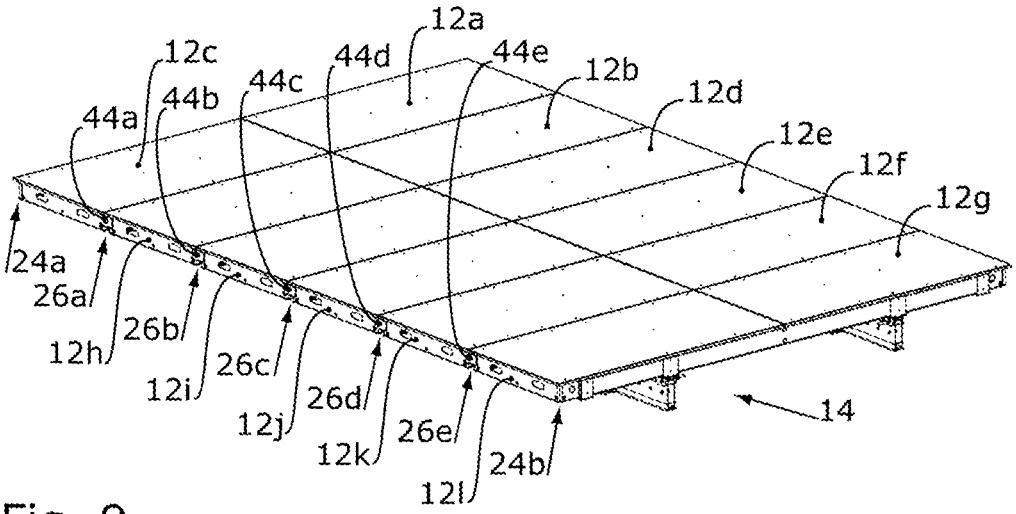
FIG. 9 is a perspective view of a support skeleton fully provided with formwork elements.

FIG. 9 shows support skeleton 14 according to FIG. 8 with all formwork elements 12*a*-1 that can be attached to support skeleton 14. Formwork elements 12*a*-1 can optionally be inserted between central supports 26*a-e* or between central supports 26*a*, 26*e* and edge supports 24*a*, 24*b* nearest to them. The locking of formwork elements 12*a*-1 is done via end stops 44*a-e* of central supports 26*a-e* that are releasably screwed on, of which only the end stops 44*a-e* arranged on central supports 26*a-e* at one end are visible in FIG. 9 (see also FIG. 6 with respect to the end stops arranged at the other end). End stops 44*a-e* are preferably plate-shaped.

Figure 10:
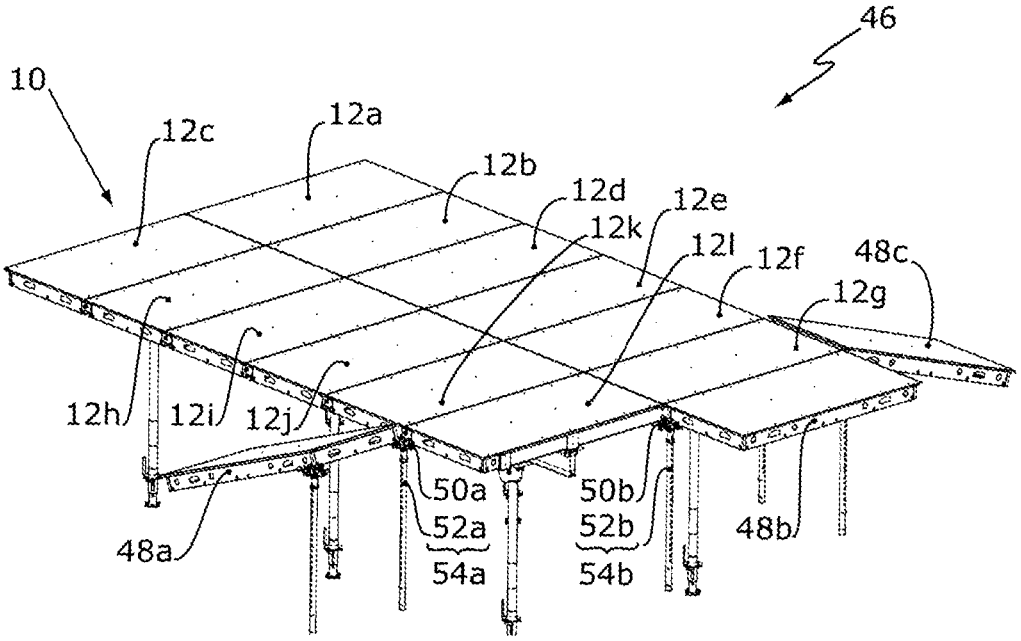
FIG. 10 is a perspective view of a ceiling formwork comprising a ceiling table and further formwork elements arranged thereon.

FIG. 10 shows a ceiling formwork 46 comprising ceiling table 10. According to the illustration in FIG. 10, further formwork elements 48*a-c* can be added onto ceiling table 10. Other formwork elements 48*a-c* are connected to ceiling table 10 via support heads, only the support heads 50*a*, 50*b* used for attachment to ceiling table 10 being visible in FIG. 10 due to the perspective representation. Support heads 50*a*, 50*b* connect formwork elements 12*g*, 12*k* to other formwork elements 48*a*, 48*b*.

Formwork elements 12*a*-1 are identical in design to other formwork elements 48*a-c*. Both formwork elements 12*a*-1 and other formwork elements 48*a-c* have coupling points (see coupling points 56*a-d* according to FIG. 11) for the connection of a support head 50*a*, 50*b*. Support heads 50*a*, 50*b* are arranged on formwork supports 52*a*, 52*b*. Support heads 50*a*, 50*b* form ceiling supports 54*a*, 54*b* together with formwork supports 52*a*, 52*b*.

Figure 11:
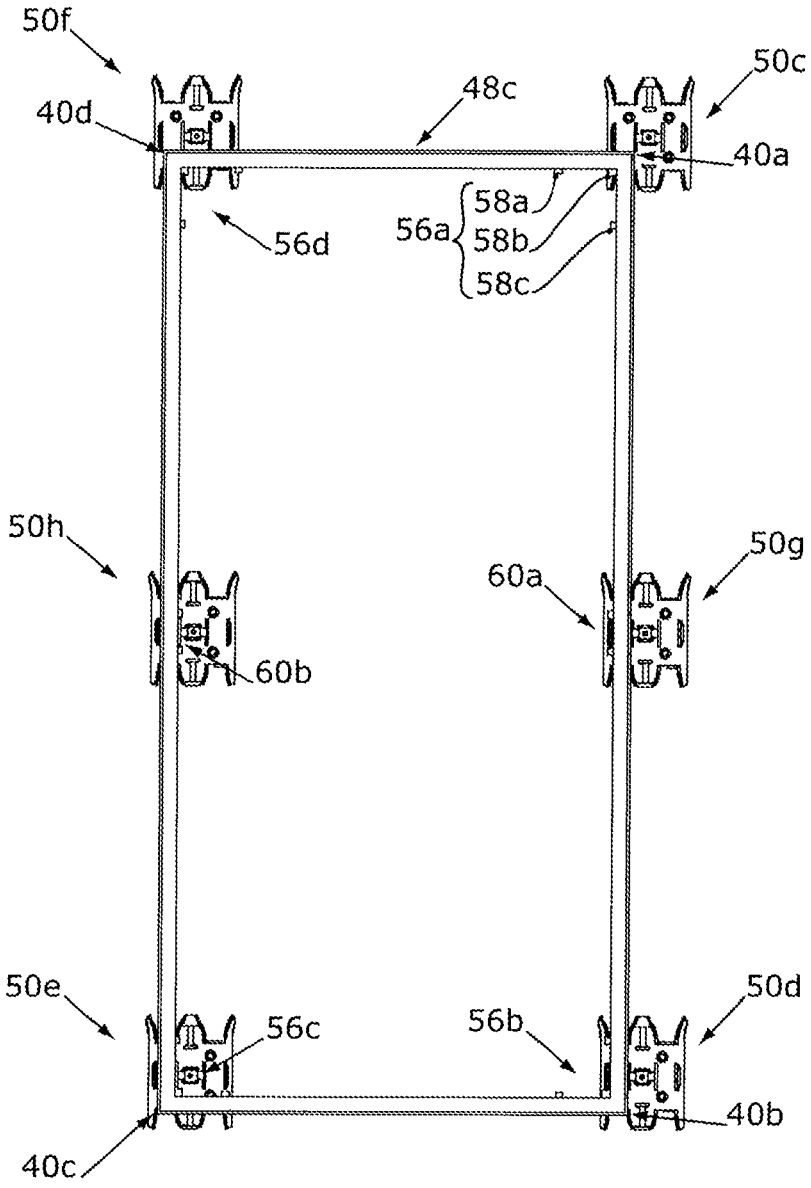
FIG. 11 is a top view of a formwork element or formwork shell, support heads being coupled to the formwork element.

FIG. 11 shows by way of example further formwork element 48*c* to illustrate the flexible connectability of further formwork elements 48*a-c* (see FIG. 10) to formwork elements 12*a*-1 (see FIG. 10). In FIG. 11, formwork shell 38 (see FIG. 7) is not visible. It can be seen from FIG. 11 that the further formwork element 48*c* has coupling points 56*a-d* in the area of its corners 40*a-d*. As shown by way of example with reference to coupling point 56*a*, coupling points 56*a-d* preferably have locking projections 58*a-c*. Coupling points 56*a-d* provide the possibility of a corner connection of a support head 50*c-f*. It can be seen from FIG. 11 that support heads 50*c-f* can be mounted on further formwork element 48*c* with various degrees of engagement such that respective support head 50*c-f* can support different numbers of other formwork elements (not shown in FIG. 11).

Further formwork element 48*c* has middle coupling points 60*a*, 60*b* to make central support of further formwork element 48*c* possible via support heads 50*g*, 50*h*.

Support heads 50*a-h* (see also FIG. 10) of ceiling formwork 46 (see FIG. 10) are preferably identical in design.

Figure 12:
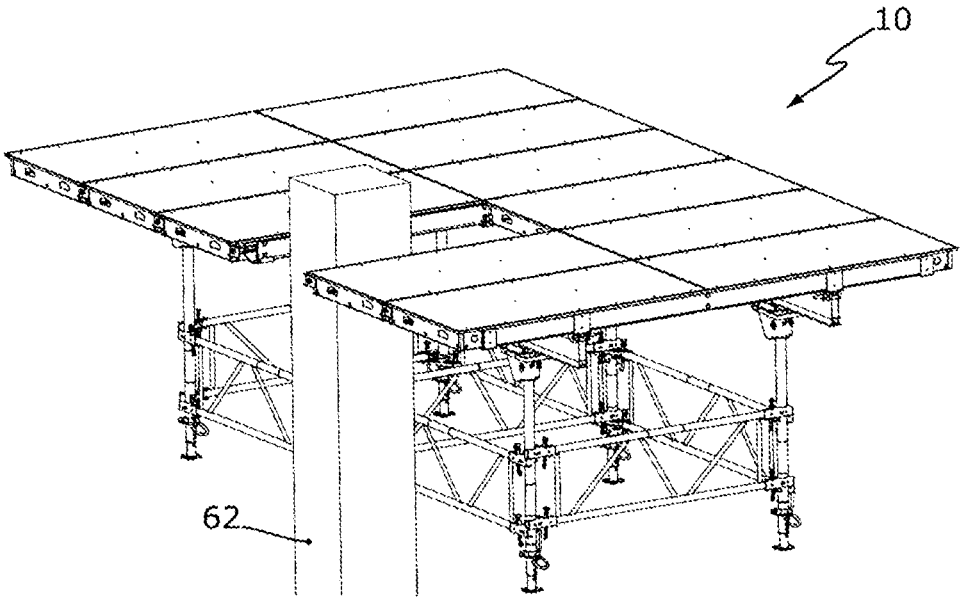
FIG. 12 is a perspective view of a ceiling table comprising a removed formwork element.

FIG. 12 shows a ceiling table 10. Ceiling table 10 corresponds to ceiling table 10 according to FIG. 1. However, formwork element 12*j* (see FIGS. 9 and 10) was not mounted. As a result of this, ceiling table 10 can be used at the construction site despite a concrete column 62.

Figure 13:
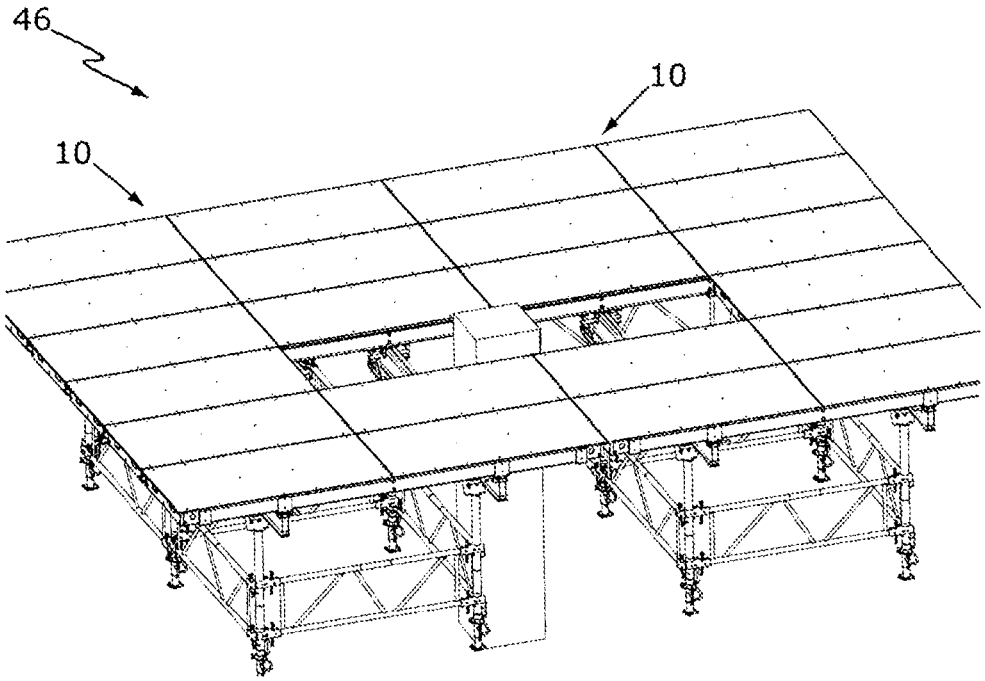
FIG. 13 is a perspective view of two ceiling tables according to FIG. 12.

FIG. 13 shows a ceiling formwork 46 in which two ceiling tables 10 are fitted together according to FIG. 12 to frame concrete column 62.

When viewing all figures of the drawing together, the invention relates, in summary, to a ceiling table 10 for the partial formwork of a concrete ceiling. Ceiling table 10 has at least one formwork element 12*a*-1, in particular multiple formwork elements 12*a*-1, that can be assembled on a lower frame 16 of ceiling table 10 in a nondestructive manner and can be disassembled from lower frame 16. Ceiling table 10 has a support skeleton 14 on which at least one formwork element 12*a*-1, in particular multiple formwork elements 12*a*-1, is/are arranged. Support skeleton 14 can have multiple struts that can be connected together and separated from one another in a nondestructive manner. The support skeleton preferably has a pair of main supports 20*a*, 20*b*, in particular parallel running main supports, on which a pair of edge supports 24*a*, 24*b* and at least one central support 26*a-e* that is arranged between the edge supports 24*a*, 24*b* are arranged. Edge supports 24*a*, 24*b* and central support 26*a-e* preferably run parallel to each other. The invention further relates to a ceiling formwork 46 comprising such a ceiling table 10.

The invention claimed is:

1. A ceiling table of a ceiling formwork, the ceiling table comprising:

a lower frame comprising multiple supports;

a support skeleton that is attached to the lower frame, the support skeleton comprising a first main support and a first edge support, the first edge support being arranged on the first main support in a reversibly detachable manner, wherein the support skeleton has at least one central support that is arranged on the first main support in a reversibly detachable manner, a longitudinal axis of the at least one central support running parallel to a longitudinal axis of the first edge support; and a plurality of formwork elements, the formwork elements each having a formwork element frame and a formwork shell arranged on the formwork element frame, at least a plurality of the plurality of formwork elements being attached to the support skeleton in a reversibly detachable manner, at least one formwork element of the plurality of formwork elements having a coupling point for arranging a support head of the ceiling formwork, wherein two formwork elements of the plurality of formwork elements are arranged between two central supports or between an edge support and the central support nearest to the edge support and can be mounted independently of one another on the support skeleton and can be removed from the support skeleton, wherein the formwork elements are selectively insertable between the central supports or between the central supports and the edge supports nearest to them, wherein the formwork elements are locked by releasably screwed-on end stops of the central supports.

2. The ceiling table according to claim 1, wherein all of the plurality of formwork elements are attached to the support skeleton in a reversibly detachable manner.

3. The ceiling table according to claim 1, wherein a longitudinal axis of the first main support runs perpendicular to a longitudinal axis of the first edge support.

4. The ceiling table according to claim 1, wherein the support skeleton has a second edge support that is attached to the first main support in a reversibly detachable manner.

5. The ceiling table according to claim 4, wherein a longitudinal axis of the second edge support runs parallel to a longitudinal axis of the first edge support.

6. The ceiling table according to claim 1, wherein the support skeleton has a second main support, a longitudinal axis of the second main support runs parallel to the first main support, the second main support being arranged on at least one of the first edge support or the second edge support in a reversibly detachable manner.

7. The ceiling table according to claim 1, wherein the lower frame has at least one roll at multiple supports.

8. The ceiling table according to claim 1, wherein at least one formwork element of the plurality of formwork elements has at least one plastic corner.

9. The ceiling table according to claim 1, wherein two formwork elements are of identical design each reversibly and detachably fastened to the support skeleton.

10. The ceiling table according to claim 1, wherein the releasably screwed-on end stops of the central beams each locking two locked formwork elements which are opposite each other with respect to the central beam on which the end stop is screwed.

11. A ceiling formwork comprising a ceiling table, the ceiling table comprising:

a lower frame comprising multiple supports;

a support skeleton that is attached to the lower frame, the support skeleton comprising a first main support and a first edge support, the first edge support being arranged on the first main support in a reversibly detachable manner, wherein the support skeleton has at least one central support that is arranged on the first main support in a reversibly detachable manner, a longitudinal axis of the at least one central support running parallel to a longitudinal axis of the first edge support;

a plurality of formwork elements, the formwork elements each having a formwork element frame and a formwork shell arranged on the formwork element frame, at least a plurality of the plurality of formwork elements being attached to the support skeleton in a reversibly detachable manner, at least one formwork element of the plurality of formwork elements having a coupling point for arranging a support head of the ceiling formwork, wherein two formwork elements of the plurality of formwork elements are arranged between two central supports or between an edge support and the central support nearest to the edge support and can be mounted independently of one another on the support skeleton and can be removed from the support skeleton, wherein the formwork elements are selectively insertable between the central supports or between the central supports and the edge supports nearest to them, wherein the formwork elements are locked by releasably screwed-on end stops of the central supports;

a support head; and a further formwork element, the support head being arranged on the further formwork element in a reversibly detachable manner and arranged on the ceiling table in a reversibly detachable manner.

12. The ceiling formwork according to claim 11, wherein the ceiling formwork has a ceiling support comprising the support head and a formwork support.

* * * * *